US008128357B2

(12) United States Patent
Bergander et al.

(10) Patent No.: US 8,128,357 B2
(45) Date of Patent: Mar. 6, 2012

(54) STATOR BLADE SEGMENT OF A THERMAL TURBOMACHINE, ASSOCIATED PRODUCTION METHOD AND ALSO THERMAL TURBOMACHINE

(75) Inventors: Katharina Bergander, Berlin (DE); Georg Bostanjoglo, Berlin (DE); Tobias Buchal, Düsseldorf (DE); Winfried Eβer, Bochum (DE); Dirk Goldschmidt, Moers (DE); Torsten Koch, Oberhausen (DE); Rudolf Küperkoch, Essen (DE); Thorsten Mattheis, Mülheim (DE); Jan Münzer, Berlin (DE); Ralf Müsgen, Essen (DE); Matthias Oechsner, Mülheim an der Ruhr (DE); Ursula Pickert, Mülheim an der Ruhr (DE); Volker Vosberg, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 580 days.

(21) Appl. No.: 12/225,933

(22) PCT Filed: Feb. 21, 2007

(86) PCT No.: PCT/EP2007/051669

§ 371 (c)(1), (2), (4) Date: Mar. 26, 2009

(87) PCT Pub. No.: WO2007/113053

PCT Pub. Date: Oct. 11, 2007

(65) Prior Publication Data

US 2009/0304503 A1 Dec. 10, 2009

(30) Foreign Application Priority Data

Apr. 6, 2006 (EP) ..... 06007332

(51) Int. Cl.
*F04D 29/44* (2006.01)

(52) U.S. Cl. ..... 415/209.4

(58) Field of Classification Search ..... 415/209.4, 415/209.3, 209.2, 173.1, 189, 190, 211.2; 403/327

See application file for complete search history.

(56) References Cited

U.S. PATENT DOCUMENTS

| | | | | |
|---|---|---|---|---|
| 2,402,005 | A | 6/1946 | Amundsen | |
| 2,942,844 | A | 6/1960 | Neate | |
| 3,072,380 | A | 1/1963 | Hennig | |
| 5,848,854 | A * | 12/1998 | Brackett | 403/327 |
| 2002/0182067 | A1 | 12/2002 | Tiemann | |

FOREIGN PATENT DOCUMENTS

| | | |
|---|---|---|
| EP | 1 149 984 A2 | 10/2001 |
| EP | 1462616 A2 | 9/2004 |

(Continued)

*Primary Examiner* — Alexander Gilman

(57) ABSTRACT

The invention relates to a guide blade segment of a thermal turbomachine, in particular a gas turbine, comprising a number of profiled blades which are arranged on a platform. A plurality of securing elements for securing the guide blade segment to an associated guide blade support are arranged on the side of the platform which is oriented away from the blade. The aim of the invention is to provide a guide blade segment which can be produced in a simple and economical manner avoiding casting problem areas enabling the guide blade segment to be attached in a particularly reliable and secure manner to the associated guide blade support. According to the invention, at least one section of at least one of the securing elements is a separately produced component which is rigidly connected to the platform or to an additional section of the securing element.

18 Claims, 1 Drawing Sheet

FOREIGN PATENT DOCUMENTS

| | | | |
|---|---|---|---|
| EP | 1 505 259 | A1 | 2/2005 |
| FR | 2825780 | A1 | 12/2002 |
| JP | 2001303905 | A1 | 10/2001 |
| RU | 2204021 | C2 | 5/2003 |
| SU | 859656 | A1 | 8/1981 |

* cited by examiner

STATOR BLADE SEGMENT OF A THERMAL TURBOMACHINE, ASSOCIATED PRODUCTION METHOD AND ALSO THERMAL TURBOMACHINE

CROSS REFERENCE TO RELATED APPLICATIONS

This application is the US National Stage of International Application No. PCT/EP2007/051669, filed Feb. 21, 2007 and claims the benefit thereof. The International Application claims the benefits of European application No. 06007332.7 filed Apr. 6, 2006, both of the applications are incorporated by reference herein in their entirety.

FIELD OF INVENTION

The invention relates to a stator blade segment of a thermal turbomachine, especially a gas turbine, with at least one profiled blade airfoil which is arranged on a platform, wherein a number of fastening elements for fastening the stator blade segment on an associated stator blade carrier are arranged on the essentially flat side of the platform which faces away from the blade airfoil.

BACKGROUND OF THE INVENTION

Gas turbines are used in many fields for driving generators or driven machines. In this case, the energy content of a fuel is used for creating a rotational movement of a turbine shaft. For this purpose, the fuel is combusted in a combustion chamber, wherein compressed air is supplied by an air compressor. The operating medium, at high pressure and at high temperature, which is produced in the combustion chamber as a result of the combustion of the fuel, is guided through a turbine unit, which is connected downstream to the combustion chambers, where the operating medium expands, performing work.

For creating the rotational movement of the turbine shaft, a number of rotor blades, which are customarily assembled into blade groups or blade rows, are arranged on this turbine shaft and via an impulse transfer from the flow medium drive the turbine shaft. For guiding the flow medium in the turbine unit, moreover, stator blade rows which are connected to the turbine casing are customarily arranged between adjacent rotor blade rows. For suitable guiding of the operating medium, the turbine blades, especially the stator blades, customarily have a profiled blade airfoil extended along a blade axis and upon which a platform, which extends transversely to the blade axis, is formed onto the end face for fastening the turbine blade on the respective carrier body. The upper side of the platform which faces the blade airfoil forms an outer delimiting surface for the flow passage of the gas turbine which guides the hot gas.

For the simple and secure installing and fixing on a stator blade carrier which is connected to the turbine casing, the platform of the respective stator blade customarily has a number of hook-like fastening elements on its underside or rear side which faces away from the blade airfoil. A similar type of hook fastening of a guide ring which bridges the axial gap of two stator blades of adjacent turbine stages is known for example from EP 1 505 259 A1. For the installing, the stator blade with its fastening elements or fastening hooks is inserted, aligned and then fixed in a suitable manner, for example by means of caulking plates, in corresponding locating slots of a stator blade carrier. In the case of the aforementioned guide ring, according to EP 1 505 259 A1 an additional fastener is also provided, by means of which the hook of the guide ring can be further clamped in the stator blade carrier.

Moreover, the fastening of a stator blade of the first turbine stage is known from U.S. Pat. No. 2,942,844. The stator blade comprises an inner platform upon which a flange, which extends transversely to it, is welded. For fastening the stator blade, the flange, which is provided with a hole, is fastened in a non-positive-locking manner on a support structure by means of a screw which extends through the hole.

For reducing the production or installation cost, a plurality of stator blade airfoils of a stator blade row, which are adjacent to each other in the circumferential direction of the gas turbine, can also be arranged on a common platform, so that the complete blade unit, which is subsequently referred to as a stator blade segment, can be inserted axially or in the circumferential direction into the associated stator blade carrier by means of the fastening hooks on the platform side. For simplification of the way of speaking, the term "stator blade segment" in the following text, especially also in the claims, is always to also include the case of an individual stator blade with only one blade airfoil, provided that this is not specifically excluded.

The stator blade or the complete stator blade segment is customarily produced within the scope of a casting process so that the platform and the fastening elements on the platform side are integral co-cast component parts of the stator blade or of the stator blade segment. For this purpose, in a first step a so-called wax model of the blade or of the blade segment is manufactured and then provided with a ceramic coating as a result of repeated immersing in a ceramic mass. As soon as this has a sufficient thickness, the wax model which is provided with the ceramic coating is burned out, wherein the ceramic hardens and the liquefied or evaporated wax is removed. The negative casting mold of ceramic which is obtained in this way is finally cast with the metal blade material. After solidification of the melt and the removal of the shell-like outer casting mold, ceramic core elements which possibly still remain in the blade body and which were previously introduced for the forming of cavities or cooling passages which are integrated in the blade bodies are removed by leaching with caustic soda or the like.

The fastening elements, which project like a hook from the platform, create difficulties within the scope of the manufacturing process in several aspects. The production of the wax model is already relatively complicated since for forming the fastening hooks comparatively complex wax molds with a large number of so-called masking elements or slides are required. Also, the fastening hooks represent problem areas with regard to casting technique, since the undercuts when constructing the mold shells can only be poorly sanded and during the subsequent casting process, on account of their exposed position, are always prone to the formation of blowhole fields, i.e. to material defects which are created as a result of heat shrinkage in the component as it cools down.

Moreover, it is frequently difficult to meet the tolerances which are required for an accurately fitting seating of the fastening hook in the associated locating slot, especially in the case of embodiment variants with comparatively small radii of curvature. As a result, sealing problems can also occur at this point during subsequent operation of the turbine. Finally, it has been shown that the fastening hooks often also represent weak points of the turbine blades with regard to their wear characteristic under operational load and with regard to the permissible maximum load input.

SUMMARY OF INVENTION

The invention is therefore based on the object of disclosing a stator blade segment of the type mentioned in the introduction which, with a manufacture which is kept simple and inexpensive, and avoiding problem zones related to casting technique, is designed for an especially reliable and secure fastening on an associated stator blade carrier. Furthermore, a method which is suitable for the production of the stator blade segment is to be disclosed.

With regard to the stator blade segment, the object is achieved by at least one section of at least one of the fastening elements being a separately produced component which is connected in a fixed manner to the side of the platform which faces away from the blade airfoil.

The invention in this case is based on the consideration that the casting material for the stator blade segment should be customarily optimized for a high resistance to high temperature in order to thus ensure a high operational safety and structural stability and also a service life which is as long as possible of the sections which are directly exposed to the hot operating medium, especially of the blade airfoils which project into the flow passage of the gas turbine and of the upper side of the platform which faces the flow passage. Such a design, however, as has now become apparent, is possibly not optimum for the fastening elements, including the hooks, which are functionally and also structurally decoupled from the remaining blade segment and which on the one hand, as a result of the projecting platform, are exposed to an only comparatively low thermal stress, but which on the other hand have to absorb relatively high mechanical loads and bearing or retaining forces. To avoid the disadvantages which have existed up to now, it is proposed according to the concept which is presented here to separately produce the fastening elements, that is to say the fastening hook or hooks, which are functionally decoupled from the remaining stator blade segment, by using a material which is consistently adapted to the respective technical function and only subsequently to that, by means of a suitable joining method, to connect the functionally decoupled elements to the remaining fastening element of to the platform of the remaining stator blade segment which for example is produced in an approved casting technique, i.e. integrally constructed.

For the permanent connection to the platform of the stator blade or of the stator blade segment, the respective fastening element comprises a connecting element which is provided with a bearing surface. For an especially uniform distribution of bearing or connecting forces and for a precise alignability of the fastening element relative to the platform, the connecting element is expediently constructed in the style of a flat connecting plate with a flat bearing surface. To realize a low installation height, the connecting element or the connecting plate can be arranged in a recessed manner in a corresponding recess of the platform, wherein as a result of this a stator blade segment which is simple to produce can especially be disclosed since the geometry of the stator blade segment hooks which is difficult to access for the casting production has been eliminated.

It can be advantageous to separately manufacture only an outer section, which faces away from the platform, of the respective fastening element and to connect this outer section to an inner section which is formed onto the platform, for example by means of a "compensating" joint, especially by means of soldering. Consequently, the cast part which comprises the platform and the formed-on section of the fastening element can be produced with comparatively roughly selected tolerances. It is especially advantageous, however, to produce the complete fastening element as a separate component.

In the case of this at least two-component construction of the stator blade segment, not only the material selection for the fastening elements with regard to the requirements of the "hooked" fastening on the stator blade carrier can be optimized, for example with regard to load input, wear and/or sealing; furthermore, for example, the difficulties which are described in the introduction when producing the wax model or during the casting process are also dispensed with. Despite the additional manufacturing step which accompanies the joining process, the manufacture of the stator blade segment is altogether considerably simpler as a result.

In an especially expedient development, the respective fastening element comprises a fastening hook which projects from the platform, is bent down at an angle, and which in its shape and contour is adapted to the associated locating slot of a stator blade carrier. An essentially straight profiled section, which can be inserted into a polygon-like locating slot in the turbine casing, represents a possible alternative to this.

The connecting element is advantageously fixed in a positive-locking manner in a recess or slot of the platform which is matched to the shape of the connecting element. Such a positive-locking connection for example is provided by the platform in the edge region of the recess or of the slot having a number of projections which grip round the connecting element in each case on its side which faces away from the bearing surface. For installing the fastening element on the platform, for example the connecting element is then inserted sideways into the recess or into the locating slot of the platform and then in a suitable manner, for example in a positive-locking, non-positive-locking and/or materially-bonding manner, fixed against slipping out sideways. Since the connecting forces are absorbed essentially by means of the projections which grip round the connecting element in a positive-locking manner, the additional fixing needs only to be designed for comparatively low loads.

Instead of the positive-locking connection between the connecting element and the platform, or additionally to it, a materially-bonding connection, preferably by soldering or welding, can also be provided.

The respective fastening element, for a high mechanical load-bearing capability, is preferably produced integrally from a single-component workpiece. In this case, for example the fastening hook can be milled or extruded as a straight profiled section and, in a second working step, bent into the required radius. The fastening element is preferably produced from a material which in comparison to the remaining stator blade segment is less resistant to high temperature but on the other hand is tougher.

For a secure fastening on the stator blade carrier, the stator blade or the stator blade segment expediently has a multiplicity of fastening elements, wherein each of the fastening elements is preferably a component which is separately produced and designed in the manner which is described above.

A gas turbine customarily has a plurality of turbine stages, wherein each of the turbine stages comprises a large number of stator blades which are arranged in the circumferential direction around the flow passage on the turbine casing and collectively form a stator blade row. In this case, as already mentioned in the introduction, a plurality of adjacent stator blades can be grouped together in each case for forming a stator blade segment or a "multiple". Each of the stator blades or each stator blade segment expediently has a platform with hook-like fastening elements, wherein the specifications for the hooking profile with regard to bend angle and/or bend radius as a rule vary with the installed position, i.e. especially depend upon the turbine stage or upon the stator blade row. A normalized or standardized construction of the connecting elements and of the corresponding slots or recesses on the platform side, by means of which the fastening elements are connected to the respective platform, is especially advantageous in this connection. Also, the respective profiled section from which the fastening hook is created by bending can look the same in the original "raw state" for all the fastening elements. One and the same fastening element, therefore, in principle can be used for all the turbine stages of a turbine; only the bend radius and/or the bend angle of the fastening hook has to be adapted to the respective place of installation or to the respective intended purpose. The bending of the profiled section is expediently carried out before connecting the connecting element to the platform of the stator blade segment because this makes the handling and the carrying out of the bending process easier. However, in principle it is also possible to bend the fastening hook into the desired or required shape only after the connecting of the fastening element and platform.

The advantages which are achieved with the invention consist particularly in the following points:

The material selection for the fastening element can be optimized for the hooking requirements, especially with regard to load input, wear and/or sealing.

The manufacture of the stator blade or of the stator blade segment becomes altogether considerably simpler.

Tolerances can be more simply established or met.

A hooking profile can be used as standard for largely all the turbine stages/performance classes and by means of different bend radii can be adapted to the respective intended purpose.

Problem zones in the cast component related to casting technique are avoided.

The wax molds for the stator blades become simpler, having fewer inserts or slides.

The advantages in the case of a stator blade segment with a plurality of blade airfoils on a common platform carry a lot more weight than in the case of a single blade.

BRIEF DESCRIPTION OF THE DRAWINGS

An exemplary embodiment of the invention is explained in more detail with reference to a drawing. In the drawing.

Like parts are provided with the same designations in all the figures.

DETAILED DESCRIPTION OF INVENTION

Figure 1:
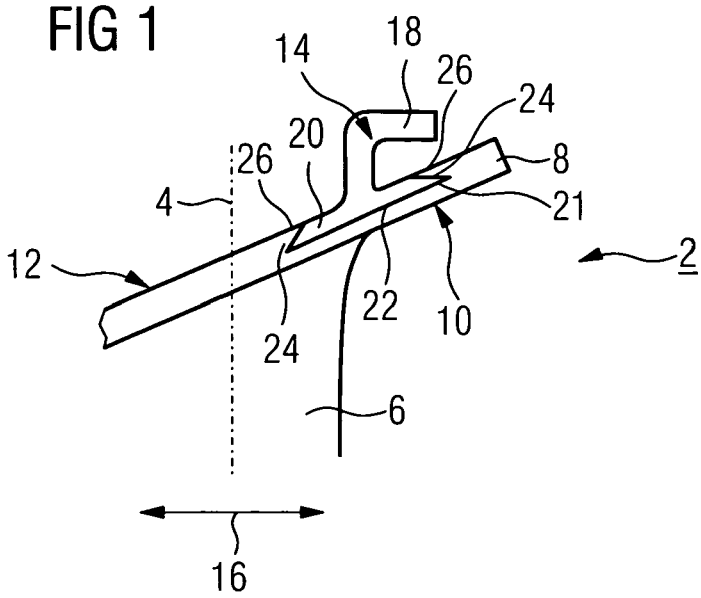
FIG. 1 shows a stator blade with a fastening element according to a first embodiment.

The stator blade 2, which is shown in FIG. 1 in a schematic side view in detail and partially sectioned, comprises a profiled blade airfoil 6 which extends in the direction of the blade axis 4 and onto which a platform 8, which is orientated essentially transversely to the blade axis 4, is formed in the region of the blade root. In the installed state of the stator blade 2, the "upper side" 10 of the platform 8 which is oriented towards the blade airfoil 6 forms an outer limit of a hot gas-guiding flow passage in a gas turbine (not shown). A number of hook-liked fastening elements 14, by means of which the stator blade 2 is suspended/fastened in an associated stator blade carrier (not shown) on the turbine casing, are located on the essentially flat "underside" 12 or rear side of the platform 8 which faces away from the blade airfoil 6. In the figure detail which is shown here, only one of the fastening elements 14 is visible, which is attached close to the trailing edge of the blade airfoil 6 with regard to the axial direction 16; a further fastening element is arranged in the proximity of the leading edge which is no longer shown here.

The fastening element 14, with a manufacture which is kept simple and inexpensive, is adapted specifically to the mechanical loads which are associated with the hooking in the stator blade carrier. For this purpose, the fastening element 14 is constructed as a separate component which is produced independently from the remaining stator blade 2 and only subsequently connected to it, wherein the material which is used for the fastening element 14 is less resistant to high temperature but on the other hand is tougher than the material from which the blade airfoil 6 and the platform 8 are produced.

The fastening element 14, in addition to a fastening hook 18 which projects from the rear side 12 of the platform 8 and is angled approximately at right angles, comprises a connecting plate 20, with a rectangular base surface, which is formed onto the fastening hook. The connecting plate 20 is fixed in a positive-locking manner in an associated recess 21 of the platform 8. By its flat bearing surface 22 the connecting plate 20 abuts flat upon the base surface of the recess 21. The depth of the recess 21 corresponds to the thickness of the connecting plate 20 so that a step-free transition in the edge region to the platform surface is created.

To realize the positive-locking connection, in the exemplary embodiment according to FIG. 1 two opposite longitudinal edges 24 of the connecting plate 20 are beveled in such a way that they are gripped or enclosed on the edge of the recess 21 on the platform side by projections 26 which are complementary to the longitudinal edges 24 and extend parallel to them. As a result, the projections 26 form a guiding and fastening rail which extends perpendicularly to the plane of the drawing and into which the connecting plate 20 is inserted for installing the fastening element 14. In order to prevent an unwanted slipping or shifting in this direction, additional fixing means, which are not shown here, can be provided. A displacement in the other two spatial directions, that is to say parallel to the blade axis 4 for one thing and in the axial direction 16 for another thing, is excluded as a result of the positive-locking attachment. Corresponding bearing and retaining forces are absorbed predominantly by the beveled longitudinal edges 24 of the connecting plate 20 and by the corresponding projections 26 on the platform side. With the edge length of the connecting plate 20 being selected to be correspondingly large, the forces which are effective per length section are relatively small and are therefore easily controllable. It is self-evident that the person skilled in the art can modify many of the details of the connection between fastening element 14 and platform 20 without deviating from the principle of the positive locking which is shown in FIG. 1.

Figure 2:
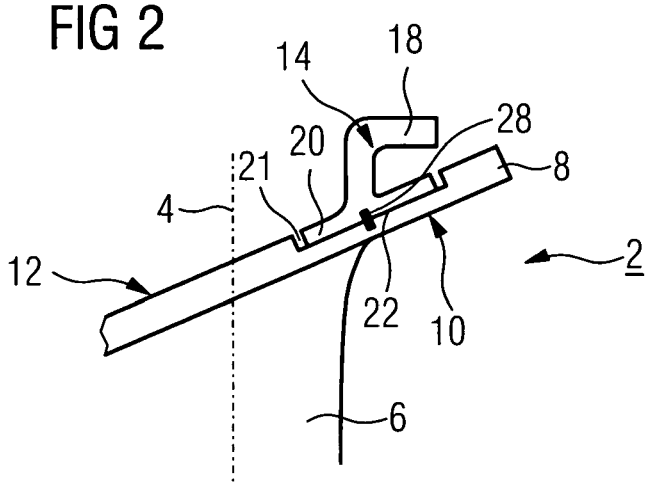
FIG. 2 shows a stator blade with a fastening element according to a second embodiment.

The fastening element 14 which is shown in FIG. 2 is similar to the fastening element 14 according to FIG. 1 with its connecting plate 20 arranged in a recessed manner in an associated recess 21 of the platform 8, but, unlike this, is not fixed in a positive-locking manner. Rather, the connecting plate 20 is connected to the platform 8 in a materially-bonding manner by means of a number of soldered points or soldered joints 28 between the bearing surfaces 22. For the required high-temperature soldering, a large number of solders/thermal treatments are commercially available, wherein the geometry of the soldered joints should expediently be constructed in a fully planar manner. The selection of the soldering method is essentially influenced by the operating conditions of the soldering, by the material pairing and by the compatibility with other thermal treatment requirements.

Figure 3:
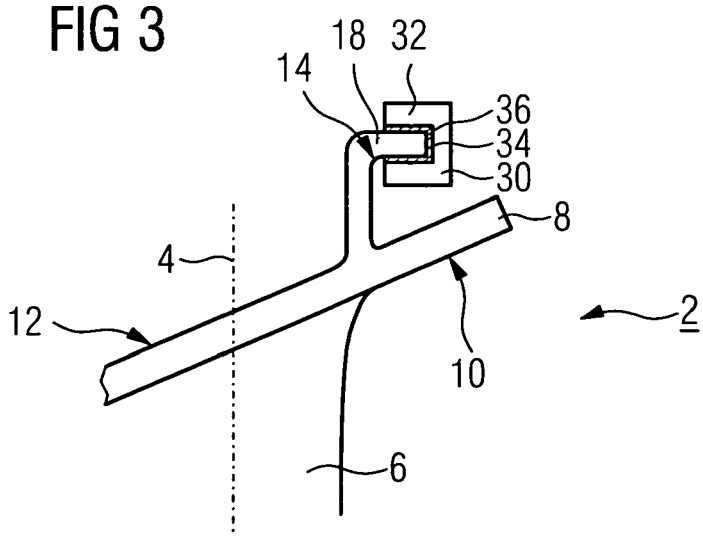
FIG. 3 shows a stator blade with a fastening element according to a third embodiment.

Finally, FIG. 3 shows a variant in which only an outer section 30 of the fastening element 14 is a separately produced component, but the remaining part is formed integrally onto the platform 8 or is cast together with it. The outer section 30, which acts virtually as an "adapter", has an enclosure 32 which is similar to a sealing cap for a bottle or a pipe, and by which the outer section encloses the component of the fastening element 14 on the platform side on its outer end. The dimensionings are selected in such a way that before introducing a means of joining a loose, clearance-related seat is created which can be adapted to the geometric specifications which exist at the respective place of installation and compensates manufacturing-related tolerances and fluctuations in the process. After such a position adjustment the two components of the fastening element 14 are interconnected by means of a soldering substance 36 which is introduced into the gap 34 and then solidified.

The invention claimed is:

1. A stator blade segment for a thermal turbomachine, comprising:

a platform having at least one essentially flat surface;

a profiled blade airfoil arranged on and extending away from the essentially flat surface of the platform facing away from the blade airfoil;

a plurality of fastening elements for fastening the stator blade segment onto an associated stator blade carrier arranged on the essentially flat side of the platform that faces away from the blade airfoil, wherein at least one of the fastening elements is a separately produced component connected in a fixed manner to the essentially flat surface of the platform that faces away from the blade airfoil, and comprises a fastening hook which projects from the platform and a connecting element having a flat bearing surface arranged in a recess formed on the essentially flat surface of the platform facing away from the airfoil, such that the fastening element is connected in a locking manner at least in an axial direction.

2. The stator blade segment as claimed in claim 1, wherein the complete respective fastening element is a separately produced component.

3. The stator blade segment as claimed in claim 2, wherein the respective fastening element is produced integrally from a single-component workpiece.

4. The stator blade segment as claimed in claim 2, wherein the respective fastening element is produced from a material that is tougher in comparison to the platform and/or to the blade airfoil.

5. The stator blade segment as claimed in claim 1, wherein the connecting element is a connecting plate.

6. The stator blade segment as claimed in claim 1, wherein the connecting element is fixed in a positive-locking manner in a recess or slot of the platform which is matched to the shape of the connecting element.

7. The stator blade segment as claimed in claim 6, wherein the platform in the edge region of the recess or of the slot has a number of projections which grip round the connecting element in each case on its side which faces away from the bearing surface.

8. The stator blade segment as claimed in one of claim 1, wherein the respective fastening element is connected in a materially-bonding manner to the platform.

9. The stator blade segment as claimed in claim 1, further comprising a plurality of blade airfoils on a common platform.

10. A gas turbine, comprising:

a rotor rotably arranged along a rotational axis;

a compressor section coaxially arranged and surrounding a portion of the rotor that produces a compressed working fluid;

a combustion section arranged downstream from the compressor section that receives the compressed working fluid and produces a hot working fluid;

a turbine section that expands the hot working fluid to produce mechanical energy, the turbine section having a stationary blade segment, comprising a platform having at least one essentially flat surface, a profiled blade airfoil arranged on and extending away from the essentially flat surface of the platform facing away from the blade airfoil, a plurality of fastening elements for fastening the stator blade segment onto an associated stator blade carrier arranged on the essentially flat side of the platform that faces away from the blade airfoil, wherein at least one of the fastening elements is a separately produced component connected in a fixed manner to the essentially flat surface of the platform that faces away from the blade airfoil, and comprises a fastening hook which projects from the platform and a connecting element having a flat bearing surface arranged in a recess formed on the essentially flat surface of the platform facing away from the airfoil such that the fastening element is connected in a locking manner at least in an axial direction.

11. The stator blade segment as claimed in claim 10, wherein the complete respective fastening element is a separately produced component.

12. The gas turbine as claimed in claim 11, wherein the respective fastening element is produced integrally from a single-component workpiece.

13. The gas turbine as claimed in claim 12, wherein the respective fastening element is produced from a material that is tougher in comparison to the platform and/or to the blade airfoil.

14. A method for producing a stator blade segment having a platform with at least one essentially flat surface, a profiled blade airfoil arranged on and extending away from the platform surface facing away from the blade airfoil, a plurality of fastening elements for fastening the stator blade segment onto an associated stator blade carrier arranged on the essentially flat side of the platform that faces away from the blade airfoil, comprising:

producing a fastening element with a fastening hook and a connecting element with a flat bearing surface, from a workpiece having an extended profiled section;

deforming the profile section to form a fastening hook where the profile section is deformed by bending; and connecting the fastening element to the platform by arranging the flat bearing surface in a recess formed on the essentially flat side of the platform facing away from the airfoil in a locking manner at least in an axial direction.

15. The method as claimed in claim 14, wherein the complete respective fastening element is a separately produced component.

16. The method as claimed in claim 15, wherein the respective fastening element is produced integrally from a single-component workpiece.

17. The method as claimed in claim 16, wherein the respective fastening element is produced from a material that is tougher in comparison to the platform and/or to the blade airfoil.

18. The method as claimed in claim 17, wherein the connecting element is a connecting plate.

* * * * *